United States Patent [19]

Yamada et al.

[11] Patent Number: 4,804,619

[45] Date of Patent: Feb. 14, 1989

[54] SILVER HALIDE COLOR PHOTOGRAPHIC LIGHT-SENSITIVE MATERIAL

[75] Inventors: Yoshitaka Yamada; Masao Iwamura, both of Hino, Japan

[73] Assignee: Konica Corporation, Tokyo, Japan

[21] Appl. No.: 112,896

[22] Filed: Oct. 23, 1987

[30] Foreign Application Priority Data

Nov. 15, 1986 [JP] Japan ..... 61-272629

[51] Int. Cl.[4] ..... G03C 1/08; G03C 1/46; G03C 5/54

[52] U.S. Cl. ..... 430/505; 430/226; 430/502; 430/503; 430/506; 430/509; 430/957; 430/958

[58] Field of Search ..... 430/502, 503, 505, 506, 430/226, 509, 957, 958, 226

[56] References Cited

U.S. PATENT DOCUMENTS

| | | | |
|---|---|---|---|
| 4,149,886 | 4/1979 | Tanaka et al. | 430/382 |
| 4,234,678 | 11/1980 | Yoshimoto et al. | 430/382 |
| 4,421,845 | 12/1983 | Uemura et al. | 430/543 |
| 4,571,378 | 2/1986 | Sauerteig et al. | 430/505 |
| 4,608,334 | 8/1986 | Shuto et al. | 430/505 |
| 4,652,515 | 3/1987 | Ogawa et al. | 430/505 |
| 4,686,175 | 8/1987 | Ogawa et al. | 430/505 |
| 4,724,198 | 2/1988 | Yamada et al. | 430/505 |

FOREIGN PATENT DOCUMENTS

| | | |
|---|---|---|
| 0114675 | 8/1984 | European Pat. Off. . |
| 1488080 | 10/1977 | United Kingdom . |

OTHER PUBLICATIONS

Research Disclosure 21228, 121, 1981.

*Primary Examiner*—Mukund J. Shah
*Attorney, Agent, or Firm*—Jordan B. Bierman

[57] ABSTRACT

A silver halide color photographic material improved in image quality such as sharpness and graininess is disclosed. The silver halide color photographic material is comprises support having thereon photographic component layers comprising at least two silver halide emulsion layers, adjacently arranged to each other, having the same color sensitivity and different speed from each other. In this photographic material the highest speed layer among these emulsion layers contains a DIR compound capable of releasing a diffusible development inhibitor or a diffusible compound capable of releasing a development inhibitor, and the total thickness of the silver halide emulsion layers is within the range of from 1.5 μm to 5 μm, and the silver halide emulsion layers are allowed to have the interposition of a non-light-sensitive intermediate layer.

23 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, and particularly, to a silver halide color photographic light-sensitive material that can obtain a high image quality.

BACKGROUND OF THE INVENTION

With recent spread of miniature cameras (for example, a disc camera and a half-size camera), there is a strong demand for achieving a high image quality of silver halide photographic light-sensitive materials. In particular, the above demand is increasingly strong in silve halide color photographic materials that have become very popular.

The silver halide color photographic materials are formed with plural color-sensitive layers, and on the other hand an effort is made for reducing the thickness of photographic component layers of the light-sensitive materials according to the demand for achieving the high image quality.

In the meantime, from view points of improvement in the color sensitivity and sharpness at the low image-frequency region, it has been practiced that the so-called DIR compound is added in the respective color-sensitive layers to achieve the improvement in sharpness by virtue of edge effect, and also to improve the graininess by appropriately restraining the development performance of silver halide. Various proposals have been made on such DIR compound in Japanese Patent Publication Open to Public Inspection (herein after referred to as Japanese Patent O.P.I. Publication) No. 131934/1984, Japanese Patent O.P.I. Publication No. 154234/1982, Japanese Patent Publication No. 27738/1986, etc. The above DIR compound may have its effect to affect also other layer than the layer to which the DIR compound has been added, so that the edge effect in all the color-sensitive layers can be emphasized and the sharpness can be remarkably improved.

Also, in order to improve the sharpness particularly at the high image-frequency region, it is very advantageous to reduce the thickness of the photographic component layers, and it is particularly demanded to reduce the thickness of the photographic component layers in the case of a low sensitivity light-sensitive photographic material for which the high image quality is strongly desired to be achieved.

On the other hand, as a part of achieving the high image quality, it has been practiced to reduce the thickness of the photographic component layers and add the above DIR compound in a low sensitivity layer among the photographic component layers. However, the present inventors had a new finding that when the effect of the DIR compound added to the low sensitivity layer is exerted on the layer other than the layer to which it has been added, it may occur that the image quality is rather deteriorated in respect of the layer to be affected. As a result of further researches, it has become clear that the above deterioration may remarkably occur and the graininess of an image, particularly the graininess at a high density portion, may be extremely deteriorated when the thickness of the light-sensitive materials is reduced, the layers with same color sensitivity are constituted as plural layers having different sensitivities, and the DIR compound is added to a lower sensitivity layer among them.

SUMMARY OF THE INVENTION

The present invention has been made in order to solve the above problems, and an object thereof is to obtain a silver halide color photographic light-sensitive material that can have photographic component layers reduced in the thickness and give good graininess of an imge, and also can attain good sharpness.

The above object can be achieved by a silver halide color photographic material comprising a support having thereon photographic component layers comprising at least two silver halide emulsion layers, adjacently arranged to each other, having the same color sensitivity and different speed from each other, wherein the highest speed layer among these emulsion layers contains a DIR compound capable of releasing a diffusible development inhibitor or a diffusible compound capable of releasing a development inhibitor, hereinafter termed as diffusible DIR compound, and the total thickness of the silver halide emulsion layers is within the range of from 1.5 to 5 μm, and the emulsion layers are made to have the interposition of a non-light-sensitive intermediate layer.

DETAILED DESCRIPTION OF THE INVENTION

The silver halide color photographic light-sensitive material of the present invention comprises at least two silver halide emulsion layers having the same color sensitivity and having different speed from each other.

Herein, the "same color sensitivity" is meant by a property to absorb light having wavelength in substantially the same wavelength region.

At least two layers of such layers having same color sensitivity and having different speed from each other are provided for the purpose of controlling the gradation of an image. Accordingly, in the case of two layer structure, there are provided a low speed layer and a high speed layer, and, in the case of three layer structure, it follows that another layer with intermediate speed is interposed therebetween. The above respective layers are formed in the manner they are adjacent to each other. Herein, what is meant by "adjacent" may of course include an instance where they are directly adjacent (or contiguous), as well as an instance where they are adjacent to each other with interposition of an intermediate layer which is not color sensitive or the above-mentioned layer with intermediate speed. In a more preferred embodiment, they comprise two layer structure.

Incidentally, to control the speed, it has been generally practiced, e.g., to change the grain size of silver halide grains contained in the silver halide emulsion layers, and such a means or any other various means can be applied in the controlling of the speed in this invention.

The light-sensitive material of the present invention can have, as color-sensitive layers, not only single-color-sensitive layers, but also multiple-color-sensitive layers. For example, preferred are those provided with blue-sensitive layers, green-sensitive layers and red-sensitive layers.

In the present invention, the highest speed layer among the adjacent silver halide emulsion layers having the same color sensitivity contains the diffusable DIR compound. Since the diffusable DIR compound is contained in the layer with the highest speed, it is possible to appropriately restrain or inhibit the development performance of the coupler contained in said layer and at the same time improve the graininess and sharpness particularly at a high density portion of an image.

The above effect is exhibited particularly remarkably in the green-sensitive layer. In the second place, the same effect is exhibited in the red-sensitive layer, and then in the blue-sensitive layer, in this order.

The diffusible DIR compound may be added preferably in an amount of not less than 0.05 mol %, more preferably 0.1 to 10 mol %, and still more preferably 0.2 to 5 mol % of the silver halide contained in the emulsion layer.

In the present invention, the above diffusible DIR compound may be contained in a layer with lower speed, but, in such an instance, the proportion thereof to the silver halide contained in the lower speed layer should preferably be lower than the proportion in the above higher speed layer and also ½ or less of the above proportion.

In the present invention, a non-diffusible DIR compound can be also used in combination. When used in combination, it may preferably used in a molar amount of ⅓ mol or more based on the diffusible DIR compound.

The above diffusible DIR compound in the present invention will be described below.

In the present invention, the diffusible DIR compound refers to a compound whose diffusibility of a development inhibitor or of a compound capable of releasing a developing inhibitor, which is capable of being split off from the DIR compound through the reaction with an oxidized product of a color developing agent, is 0.40 or more in terms of the diffusibility according to the evaluation method described below.

The diffusibility can be evaluated according to the following method:

Samples (I) and (II) are prepared.

Sample (I): A sample having a green-sensitive silver halide emulsion layer.

A gelatinous coating solution containing silver iodobromide having been spectrally sensitized to have green sensitivity (silver iodide: 6 mol %; average grain size: 0.48 μm) and 0.07 mol, per mol of silver, of the coupler shown below is coated to have a coated silver amount of 1.1 g/m$^2$ and a gelatin amount of 3.0 g/m$^2$, and a gelatinous coating solution containing silver iodobromide having been not chemically sensitized nor spectrally sensitized (silver iodide: 2 mol %; average grain size: 0.08 μm) is coated thereon as a protective layer to have a coated silver amount of 0.1 g/m$^2$ and a gelatin amount of 0.8 g/m$^2$.

Sample (II): A sample in which the silver iodobromide has been removed from the protective layer.

In the respective layers, a hardening agent and a surface active agent are contained in addition to the above.

Samples (I) and (II) are exposed to white light with use of a wedge, followed by processing according to the processing method shown below. As developing solutions, used are a solution to which a development inhibitor of every kind is added in the amount sufficient for suppressing the sensitivity of sample (II) to 60% ($<\Delta$ log E=0.22 in terms of a logarithmic indication), and a solution to which no development inhibitor is added.

| Processing steps (38° C.): | |
|---|---|
| Color developing | 2 min. 40 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

Processing solutions used in the respective processing steps have the formulation as follows.

| | |
|---|---|
| [Color developing solution] | |
| 4-Amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Made up to 1 liter by adding water. | |
| [Bleaching solution] | |
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 g |
| Made up to 1 liter by adding water, and adjusted to pH = 6.0 with use of ammonia water. | |
| [Fixing solution] | |
| Ammonium thiosulfate | 175.0 g |
| Anhydrous sodium sulfite | 8.5 g |
| Sodium metasulfite | 2.3 g |
| Made up to 1 liter by adding water and adjusted to pH = 6.0 with use of acetic acid. | |
| [Stabilizing solution] | |
| Formalin (a 37% aqueous solution) | 1.5 ml |
| Konidax (produced by Konishiroku Photo Industry Co., Ltd.) | 7.5 ml |
| Made up to 1 liter by adding water. | |

Assuming as $S_O$ the sensitivity of sample (I) when no development inhibitor is added, as $S_O'$ the sensitivity of sample (II), as $S_I$ the sensitivity of sample (I) when the

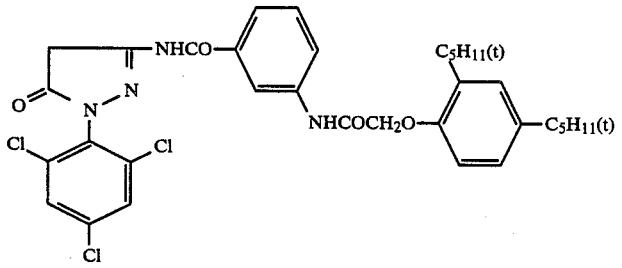

development inhibitor is added, and as $S_{II}$ the sensitivity of sample (II), the following can be represented:

Desensitization degree of sample (I): $\Delta S = S_O - S_I$

Desensitization degree of sample (II): $\Delta S_O = S_O' - S_{II}$

Diffusibility $= \Delta S / \Delta S_O$ provided that all the sensitivities are assumed as logarithms of reciprocals ($-\log E$) of the exposure amount at the density point of fog density $+0.3$.

The dispersability determined according to the above method in respect of several kinds of development inhibitors is exemplified in the following table.

TABLE

| Structure | Amount (mol/l) | Desenitization degree $\Delta S_0$ | Desenitization degree $\Delta S$ | Diffusibility $\Delta S/\Delta S_0$ |
|---|---|---|---|---|
| 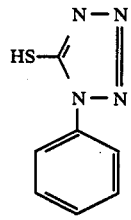 | $1.3 \times 10^{-5}$ | 0.22 | 0.05 | 0.23 |
| 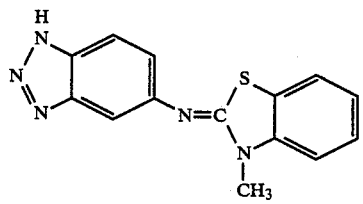 | $1.3 \times 10^{-5}$ | 0.23 | 0.08 | 0.34 |
| 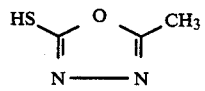 | $2.5 \times 10^{-5}$ | 0.22 | 0.10 | 0.45 |
| 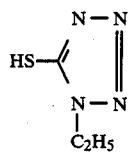 | $3.0 \times 10^{-5}$ | 0.21 | 0.10 | 0.48 |
| 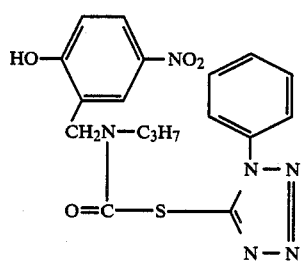 | $1.4 \times 10^{-5}$ | 0.23 | 0.11 | 0.48 |
| 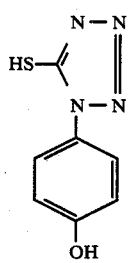 | $2.5 \times 10^{-5}$ | 0.22 | 0.13 | 0.59 |
| 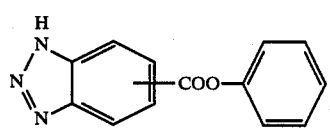 | $3.5 \times 10^{-5}$ | 0.23 | 0.15 | 0.65 |

TABLE-continued

| Structure | Amount (mol/l) | Desenitization degree $\Delta S_0$ | Desenitization degree $\Delta S$ | Diffusibility $\Delta S/\Delta S_0$ |
|---|---|---|---|---|
| 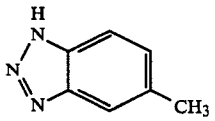 | $4.3 \times 10^{-5}$ | 0.22 | 0.16 | 0.73 |
| 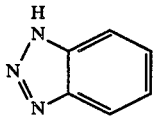 | $1.7 \times 10^{-4}$ | 0.21 | 0.20 | 0.95 |

In the present invention, any types of the diffusible DIR compounds can be used without regard to their chemical structure so long as the diffusibility of the released group is in the above range.

Typical structural formula thereof is shown below.

General Formula (D-1)

$$A\text{-}(Y)_m$$

Symbol A represents a coupler residual group; m represents 1 or 2; Y represents a group capable of bonding to the coupling position of the coupler residual group A and capable of being split off through the reaction with an oxidized product of a color developing agent, and is a development inhibiting group or a group capable of releasing a development inhibitor, having 0.40 or more of diffusibility.

In General Formula (D-1), Y is typically represented by any of General Formulas (D-2) to (D-19) shown below.

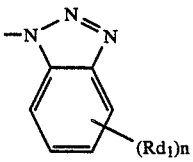

Formula (D-2)

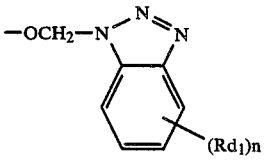

Formula (D-3)

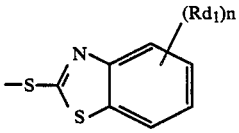

Formula (D-4)

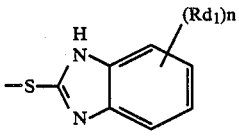

Formula (D-5)

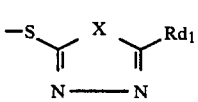

Formula (D-6)

-continued

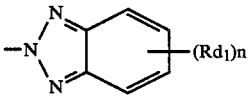

Formula (D-7)

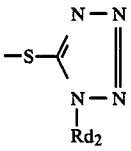

Formula (D-8)

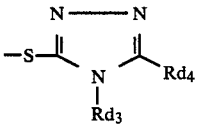

Formula (D-9)

In Formulas (D-2) to (D-7), $Rd_1$ represents a hydrogen atom, a halogen atom, or an alkyl, alkoxy, acylamino, alkoxycarbonyl, thiazolylideneamino, aryloxycarbonyl, acyloxy, carbamoyl, N-alkylcarbamoyl, N,N-dialkylcarbamoyl, nitro, amino, N-arylcarbamoyloxy, sulfamoyl, N-alkylcarbamoyloxy, hydroxy, alkoxycarbonylamino, alkylthio, arylthio, aryl, heterocyclic, cyano, alkylsulfonyl or aryloxycarbonylamino group; and n represents 0, 1 or 2, and $Rd_1$ may be the same or different when n is 2. The sum of the number of the carbon atoms contained in n of $Rd_1$s is 0 to 10. Also, the number of the carbon atoms contained in $Rd_1$ in Formula (D-6) is 0 to 15.

In Formula (D-6), X represents an oxygen atom or a sulfur atom.

In Formula (D-8), $Rd_2$ represents an alkyl group, aryl group or a heterocyclic group.

In Formula (D-9), $Rd_3$ represents a hydrogen atom, or an alkyl, cycloalkyl, aryl or heterocyclic group; $Rd_4$ represents a hydrogen atom, a halogen atom, or an alkyl, cycloalkyl, aryl, acylamino, alkoxycarbonylamino, aryloxycarbonylamino, alkanesulfonamide, cyano, heterocyclic, alkylthio or amino group.

When $Rd_1$, $Rd_2$, $Rd_3$ or $Rd_4$ represents an alkyl group, this alkyl group may include those having a substituent and may be any of straight chain or branched alkyls.

When $Rd_1$, $Rd_2$, $Rd_3$ or $Rd_4$ represents an aryl group, the aryl group may include those having a substituent.

When $Rd_1$, $Rd_2$, $Rd_3$ or $Rd_4$ represents heterocyclic group, this heterocyclic group may include those having a substituent, and preferably include a single ring or condensed ring of 5 or 6 members containing as a hetero atom at least one selected from a nitrogen atom, an oxygen atom and a sulfur atom, for example, a pyridyl, quinolyl, furyl, benzothiazolyl, oxazolyl, imidazolyl, thiazolyl, triazolyl, benzotriazolyl, imide or oxazine group.

In Formulas (D-6) and (D-8), the number of the carbon atoms contained in $Rd_2$ is 0 to 15.

In the above Formula (D-9), the sum of the number of the carbon atoms contained in $Rd_3$ and $Rd_4$ is 0 to 15.

Formula (D-10)

—TIME—INHIBIT

In the formula, —TIME— represents a group capable of entering into combination with the coupling position of A and undergoing cleavage through the reaction with an oxidized product of a color developing agent, and is a group capable of releasing an —INHIBIT group with appropriate control, after cleavage from a coupler. The —INHIBIT group is a group formed into a development inhibiter by the above releasing (e.g. the group represented by any of the above Formulas (D-2) to (D-9)).

In Formula (D-10), the —TIME—INHIBIT— group is typically represented by any of Formulas (D-11) to (D-19) shown below.

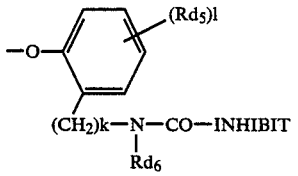

Formula (D-11)

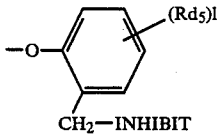

Formula (D-12)

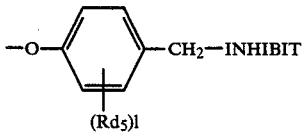

Formula (D-13)

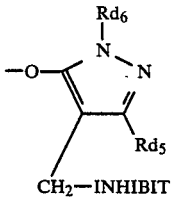

Formula (D-14)

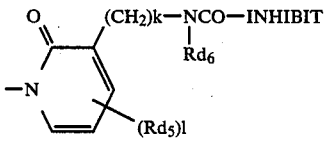

Formula (D-15)

-continued

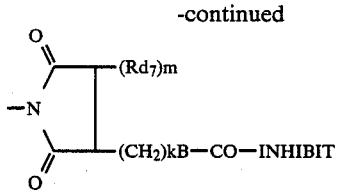

Formula (D-16)

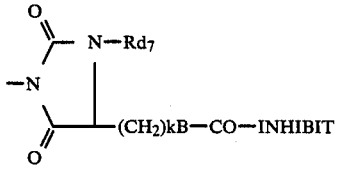

Formula (D-17)

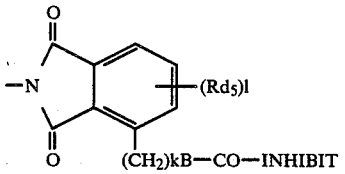

Formula (D-18)

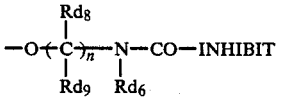

Formula (D-19)

In Formulas (D-11) to (D-15) and (D-18), $Rd_5$ represents a hydrogen atom, or an alkyl, cycloalkyl, alkenyl, aralkyl, alkoxy, alkoxycarbonyl, anilino, acylamino, ureido, cyano, nitro, sulfonamide, sulfamoyl, carbamoyl, aryl, carboxy, sulfo, hydroxyl or alkanesulfonyl group. In Formulas (D-11) to (D-13), (D-15) and (D-18), $Rd_5$ may each other combine to form a condensed ring. In Formulas (D-11), (D-14), (D-15) and (D-19), $Rd_6$ represents an alkyl, alkenyl, aralkyl, cycloalkyl, heterocyclic or aryl group. In Formulas (D-16) and (D-17), $Rd_7$ represents a hydrogen atom, or an alkyl, alkenyl, aralkyl, cycloalkyl, heterocyclic or aryl group. $Rd_8$ and $Rd_9$ in Formula (D-19) each represent a hydrogen atom or an alkyl group (preferably an alkyl group having 1 to 4 carbon atoms); k in Formulas (D-11) and (D-15) to (D-18) represents an integer of 1 or 2; l in Formulas (D-11) to (D-13), (D-15) and (D-18) represents an integer of 1 to 4; m in Formula (D-16) represents an integer of 1 or 2, and the respective $Rd_7$ may be the same or different when m is 2; n in Formula (D-19) represents an integer of 2 to 4, and $Rd_8$ and $Rd_9$ in the number of n may each be the same or different; B in Formulas (D-16) to (D-18) represents an oxygen atom or

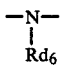

($Rd_6$ has the same meaning as defined above); ..... in Formula (D-16) indicates that the bond may be either a single bond or a double bond, wherein m is 2 when it is a single bond, and m is 1 when it is a double bond; and INHIBIT has the same meaning as the general formulas defined for Formulas (D-2) to (D-9) except for the carbon atom number.

In the INHIBIT group, the sum of the number of carbon atoms contained in $Rd_1$ in Formulas (D-2) to (D-7) is 0 to 32, that of the number of the carbon atoms contained in $Rd_2$ in Formula (D-8) is 1 to 32, and that of the number of the carbon atoms contained in $Rd_3$ and $Rd_4$ in Formula (D-9) is 0 to 32.

When $Rd_5$, $Rd_6$ and $Rd_7$ each represent an alkyl group, an aryl group or a cycloalkyl group, they may include those having a substituent.

Among the diffusible DIR compound, preferred are those wherein Y is represented by Formula (D-2), (D-3) or (D-10). Among (D-10), preferred are those wherein INHIBIT is represented by Formulas (D-2), (D-6) (particularly when X in Formula (D-6) is an oxygen atom) or (D-8) (particularly when $Rd_2$ in Formula (D-8) is a hydroxyl aryl group or an alkyl group having 1 to 3 carbon atoms).

The coupler component represented by A in Formula (D-1) may include a yellow dye image-forming coupler residual group, a magenta dye image-forming coupler residual group, a cyan dye image-forming coupler residual group, and noncoloring coupler residual group.

Examples of the diffusable DIR compound used in the present invention include the compounds as shown below, but by no means limited to these.

Exemplary compounds:

D'-1

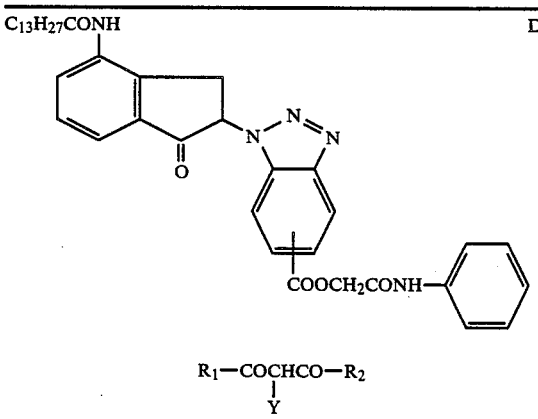

| Compound No. | $R_1$ | $R_2$ | Y |
|---|---|---|---|
| D'-2 | (1) | (1) | (30) |
| D'-3 | (2) | (3) | (30) |
| D'-4 | (2) | (4) | (30) |
| D'-5 | (5) | (6) | (31) |
| D'-6 | (2) | (4) | (32) |
| D'-7 | (2) | (3) | (32) |
| D'-8 | (7) | (8) | (33) |

The groups are specified by the number in the parentheses. The groups corresponding to the respective numbers are listed at the end of this exemplary compound, hereinafter having the same meaning in specifying the exemplary compounds.

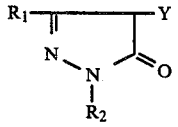

| Compound No. | $R_1$ | $R_2$ | Y |
|---|---|---|---|
| D'-9 | (9) | (10) | (30) |
| D'-10 | (11) | (10) | (30) |
| D'-11 | (12) | (7) | (34) |
| D'-12 | (12) | (13) | (35) |
| D'-13 | (9) | (14) | (36) |

-continued

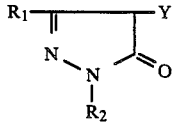

| Compound No. | $R_1$ | $R_2$ | Y |
|---|---|---|---|
| D'-14 | (15) | (16) | (37) |

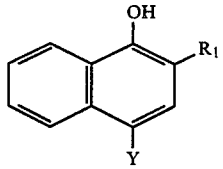

| Compound No. | $R_1$ | Y |
|---|---|---|
| D'-15 | (17) | (38) |
| D'-16 | (17) | (39) |
| D'-17 | (18) | (40) |
| D'-18 | (20) | (41) |
| D'-19 | (18) | (42) |
| D'-20 | (18) | (43) |
| D'-21 | (18) | (44) |
| D'-22 | (18) | (45) |
| D'-23 | (19) | (46) |
| D'-24 | (21) | (47) |
| D'-25 | (21) | (48) |
| D'-26 | (22) | (49) |
| D'-27 | (22) | (50) |
| D'-28 | (22) | (51) |
| D'-29 | (23) | (52) |
| D'-30 | (18) | (53) |
| D'-31 | (18) | (54) |
| D'-32 | (23) | (49) |

1

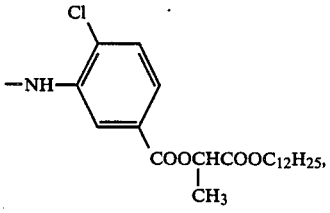

—C(CH3)3, 2

3

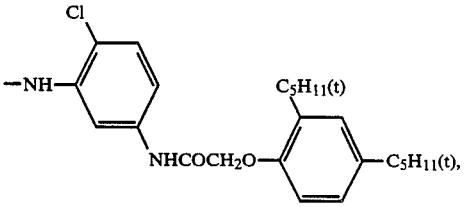

4

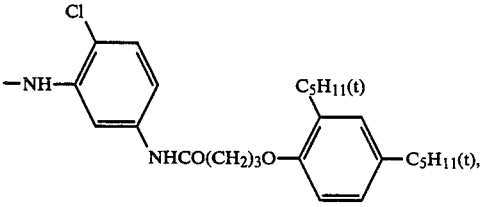

-continued
$-OCH_3$,
6
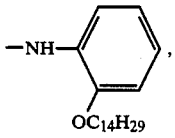
7
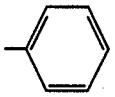
8
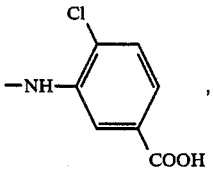
9
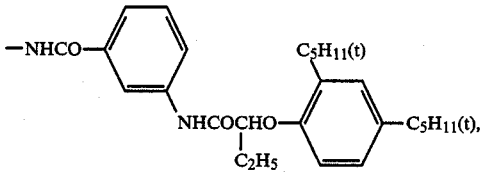
10
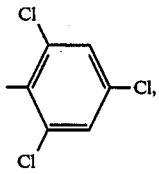
11
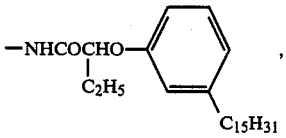
$-C_{17}H_{35}$,
12
13
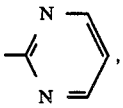
14
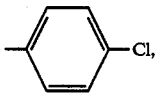
$-CH_3$,
15
16
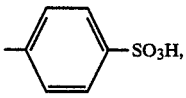
$-CONHC_{18}H_{37}$,
17
18
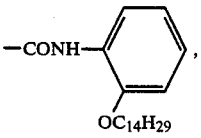
-continued
19
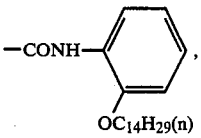
20
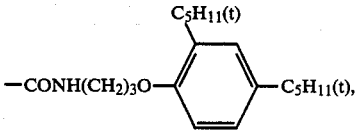
21
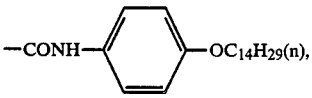
22 $-CONHCH_2CH_2COOH$
23 $-CONHCH_2CH_2COOCH_3$
30
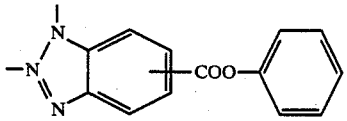
31
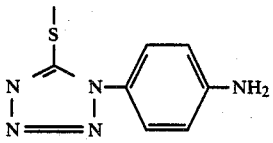
32
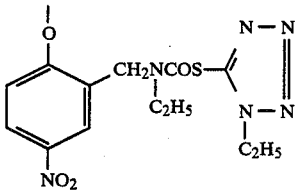
33
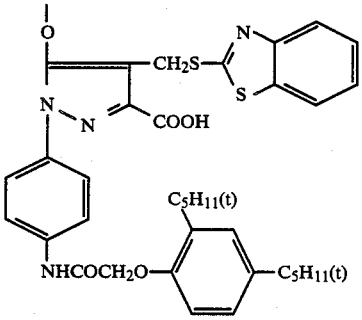
34
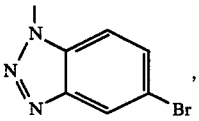
35
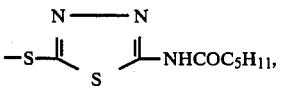

-continued
36
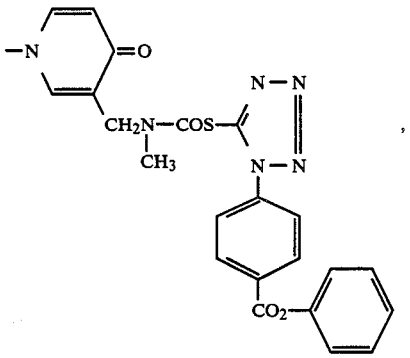
37
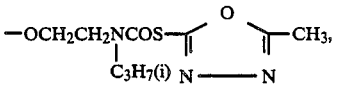
38
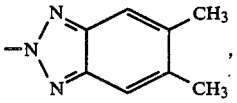
39
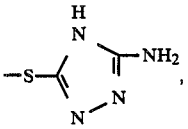
40
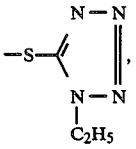
41
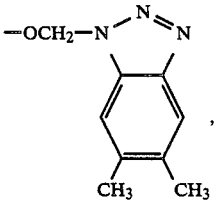
42
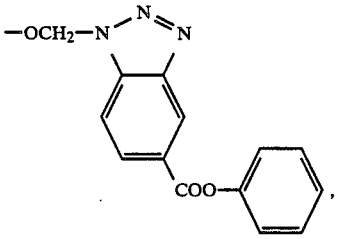
43
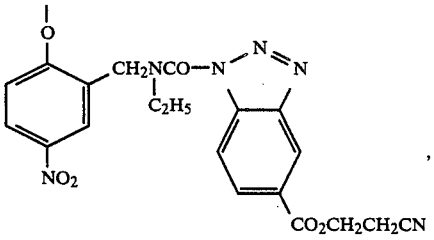
-continued
(44)
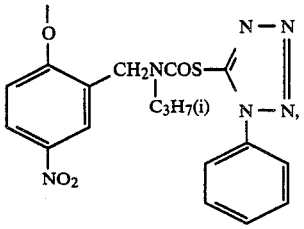
45
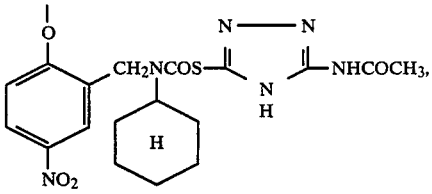
46
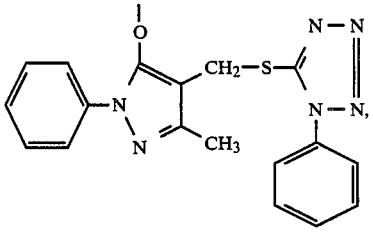
47
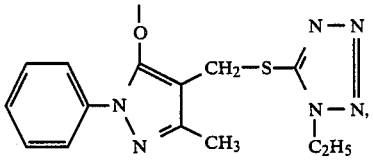
48
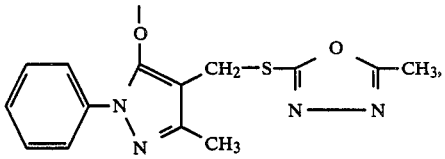
49
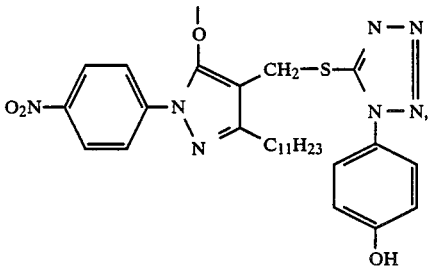
50
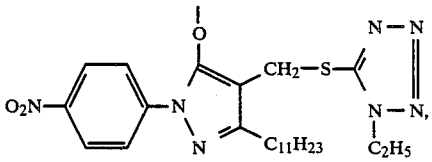

-continued

51

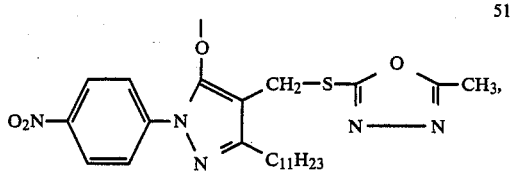

52

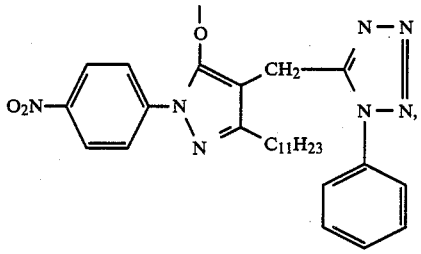

53

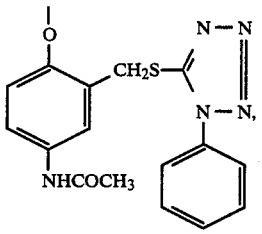

54

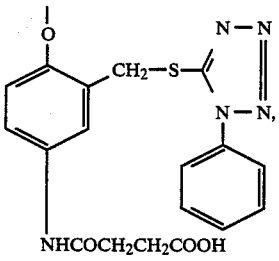

Including these, specific examples of the diffusible DIR compound that can be used in the present invention are described in U.S. Pat. Nos. 4,234,678, 3,227,554, 3,617,291, 3,958,993, 4,149,886 and 3,933,500, Japanese Patent O.P.I. Publications No. 56837/1982 and No. 13239/1976, British Pat. Nos. 2,072,363 and 2,070,266, Research Disclosure No. 21228 of December, 1981, etc.

The silver halide emulsion layers having same color sensitivity are formed to have a total layer thickness of 1.5 μm to 5 μm.

The above layer thickness is made to be 1.5 μm to 5 μm for the purpose of answering the aforesaid demand for reducing the thickness of the photographic component layers in the light-sensitive materials. By reducing the thickness, it can be achieved to improve the sharpness at the high image-frequency region to attain a high image quality. As mentioned previously, the layers having same color sensitivity are comprised of at least two silver halide emulsion layers having different speed from each other, and the layers having same color sensitivity may preferably have a layer thickness of 1.5 to 4 μm, more preferably 1.5 to 3 μm, in total.

The layer thickness refers to a dry layer thickness, which is indicated by a value measured under the condition in which the humidity has been controlled to 55% at 23° C. The layer thickness of the respective layers comprising a plurality of layers can be determined by taking an enlarged photograph with use of a scanning electron microscope and measuring the layer thickness of the respective layers.

The total layer thickness of the layers having same color sensitivity is as described above, but the layer thickness as a whole of all the photographic component layers may preferably be 18 μm or less, more preferably 10 μm or 16 μm.

A silver halide emulsion forming the above color-sensitive layer will be described below. In the silver halide emulsion, there can be used any of those used as silver halides in usual silver halide emulsion layers, such as silver bromide, silver iodobromide, silver iodochloride, silver chlorobromide and silver chloride, but preferred is an emulsion in which silver iodobromide is used. Silver halide grains used in the silver halide emulsion may be any of those obtained by an acidic method, a neutral method and an ammoniacal method. The grains may be allowed to grow at one time, or grow after seed grains have been formed. The manner to prepare the seed grains and the manner to grow them may be the same or different. The silver halide emulsion containing such grains may be obtained by simultaneously mixing halide ions and silver ions, or by preparing an aqueous solution in which either one of them is present and then mixing in it the other of them. Alternatively, taking into account the critical growth rate of silver halide crystals, it may be formed by successively simultaneously adding halide ions and silver ions while controlling pH and pAg in a mixing vessel. According to this method, it is possible to obtain silver halide grains that are regular in crystal form and substantially uniform in grain size. It is also possible to change the silver halide formulation in the grains after growth, with use of a conversion method. With regard to the silver halide emulsion thus obtained, there may be used those having any grain size distribution. Thus, there may be used a emulsion having a broad grain size distribution (called a polydispersed emulsion), or may by used an emulsion having a narrow grain size distribution (called a monodispersed emulsion), which may be used alone or as a mix of several kinds. Alternatively, a mixture of the polydispersed emulsion and monodispersed emulsion may also be used. Preferably used is the monodispersed emulsion.

Here, the "monodispersed" in the monodispersed emulsion is meant to be an emulsion having the variation coefficient in the grain size distribution of the silver halide grains to be contained in the silver halide emulsion, of 22% or less, preferably 15% or less. The variation coefficient refers to a coefficient showing the width of grain size distribution, and can be defined by the formulas shown below.

$$\text{Variation coefficient} = \frac{\text{Standard deviation of grain size distribution}}{\text{Average grain size}} \times 100$$

$$\text{Standard deviation of grain size distribution} = \sqrt{\frac{\Sigma(\bar{r} - ri)^2 ni}{\Sigma ni}}$$

$$\text{Average grain size} = \frac{\Sigma niri}{\Sigma ni} = \bar{r}$$

Here, ri represents grain size of the respective grains, and ni, the number thereof. The average grain size $\bar{r}$ indicates the length of a side in the case of a cubic silver halide grain, and, in the case of a spherical one, an average value of the length of a side when converted into a cube. When the grain size of the respective grains is ri and the number thereof is ni, the above formulas can be applied.

The above grain size can be measured according to all sort of methods generally used for the above purpose in the present technical field. A typical method is described in "Method for Analysis of Grain Size", A.S.T.S. Symposium on Light Microscopy, 1955, pp. 94–122, or Chapter II in "The Theory of The Photographic Process", coauthored by Meas and James, Third Edition, published by Macmillan Publishing Co., Inc.

The above color-sensitive layer generally includes a blue-sensitive layer, a green-sensitive layer and a red-sensitive layer. When used in full color photography, all of these color-sensitive layers are laminated to form a light-sensitive material. As mentioned above, the present invention is particularly effective in the green-sensitive layer.

Now, the green-sensitive layer contains a magenta coupler. As the magenta coupler, there can be preferably used known 5-pyrazolone type couplers, pyrazolobenzimidazole type couplers, pyrazolotriazole type couplers and open chain acylacetonitrile type couplers.

The red-sensitive layer contains a cyan coupler. As the cyan coupler, there can be preferably used naphthol type couplers and phenol type couplers.

The blue-sensitive layer contains a yellow coupler. As the yellow coupler, there can be preferably used, for example, acylacetanilide type couplers. Of these, preferred are benzoylacetaldehyde type and valoylacetanilide type compounds.

The evolution of highly color-forming couplers can further promote the trend of reducing the thickness of the color-sensitive layers, and such highly color-forming couplers are variously reported, and include, for example, polymer couplers described in Japanese Patent O.P.I. Publication No. 36249/1984, pyrazolotriazole type magenta couplers described in Japanese Patent Application No. 88394/1985, and benzoyl type yellow couplers. Accordingly, as a means for reducing the film thickness, it is preferred to use the highly color-forming couplers.

The support in the present invention may be of any materials that can support the photographic component layers, and may be either transparent or opaque. It can be selected arbitrarily from various materials depending on the purpose.

Various additives can be added in the above photographic component layers, and all kinds of photographic additives such as a wetting agent, a film property improver and a coating auxiliary can be also added depending on the purpose. As other photographic additives, there can be further used a plasticizer, a surface active agent, an ultraviolet absorbent, a pH adjuster, an antioxidant, an antistatic agent, a thickening agent, a graininess improver, a dye, a mordant, a brightening agent, a development speed regulator, a matting agent, and so forth.

Also, in order to prevent the color fading owing to active light with short wavelength, of a dye image, it is useful to use the ultraviolet absorbent, for example, thiazolidone, benzotriazole, acrylonitrile or benzophenone compounds.

In the silver halide emulsion layers used in the above light-sensitive layers, a suitable gelatin derivative can be used as a protective colloid or binding agent (binder) depending on the purpose, in addition to gelatin, and other hydrophilic binding agent (binder) can be also contained depending on the purpose. They can be added in the photographic component layers such as an emulsion layer, an intermediate layer, a protective layer, a filter layer and a subbing layer in the above light-sensitive photographic material, and the above hydrophilic binder may further contain a suitable plasticizer or wetting agent depending on the purpose.

The photographic component layers of the above light-sensitive material can also be hardened with use of a suitable hardening agent.

The silver halide color photographic light-sensitive material according to the present invention is particularly suited for a negative light-sensitive photographic material.

EXAMPLES

Specific examples of the present invention will be described below, but working embodiments of the present invention are by no means limited to these.

In all examples shown below, the amount for the addition in the silver halide photographic light-sensitive material indicates an amount per 1 $m^2$, unless particularly mentioned. Silver halide and colloidal silver are indicated in terms of silver.

On a triacetyl cellulose film support, layers having the composition as shown below were formed in sequence from the support side to produce a multi-color photographic element, sample No. 1.

Sample No. 1 (Comparative example)

First layer: Anti-alation layer (HC-1) (1.1 μm).
A gelatin layer containing black colloidal silver.

Second layer: Intermediate layer (I.L.) (0.8 μm)
A gelatin layer containing an emulsification dispersion of 2,5-di-t-octyl hydroquinone.

Third layer: Low speed red-sensitive silver halide emulsion layer (RL-1) (2.2 μm)
A monodispersed emulsion (emulsion I) comprising AgBrI containing 6 mol % of AgI and having an average grain size ($\bar{r}$) of 0.40 μm . . . 1.8 g/$m^2$ in coated silver amount
Sensitizing dye I . . . $5.0\times10^{-4}$ mol per mol of silver
Sensitizing dye II . . . $0.8\times10^{-4}$ mol per mol of silver
Cyan coupler (C-1) . . . 0.05 mol per mol of silver
Colored cyan coupler (CC-1) . . . 0.005 mol per mol of silver
DIR compound (A) . . . 0.0015 mol per mol of silver
DIR compound (D'-25) . . . 0.002 mol per mol of silver Fourth layer: High speed red-sensitive silver halide emulsion layer (RH-1) (1.8 μm)
A monodispersed emulsion (emulsion II) comprising AgBrI containing 6 mol % of AgI and having an average grain size ($\bar{r}$) of 0.8 μm . . . 1.3 g/$m^2$ in coated silver amount
Sensitizing dye I . . . $2.5\times10^{-4}$ mol per mol of silver
Sensitizing dye II . . . $1.0\times10^{-4}$ mol per mol of silver
Cyan coupler (C-2) . . . 0.07 mol per mol of silver
Cyan coupler (C-3) . . . 0.027 mol per mol of silver
Colored cyan coupler (CC-1) . . . 0.0015 mol per mol of silver Fifth layer: Intermediate layer (L.L.) (0.8 μm)
A gelatin layer same as the second layer.

Sixth layer: Low speed green-sensitive silver halide emulsion layer (GL-1) (3.2 μm)
Emulsion I . . . 1.5 g/$m^2$ in coated silver amount Sensitizing dye III . . . $1.5\times10^{-4}$ mol per mol of silver
Sensitizing dye IV . . . $1.2\times10^{-4}$ mol per mol of silver
Magenta coupler (M-1) . . . 0.062 mol per mol of silver
Colored magenta coupler (CM-1) . . . 0.004 mol per mol of silver
DIR compound (D'-32) . . . 0.003 mol per mol of silver Seventh layer: High speed green-sensitive silver halide emulsion layer (GH-1) (2.3 μm)
Emulsion II . . . 1.5 g/m² in coated silver amount
Sensitizing dye III . . . $1.2\times10^{-4}$ mol per mol of silver
Sensitizing dye IV . . . $0.8\times10^{-4}$ mol per mol of silver
Magenta coupler (M-1) . . . 0.015 mol per mol of silver
Colored magenta coupler (CM-1) . . . 0.002 mol per mol of silver Eighth layer: Yellow filter layer (YC-1) (1.0 μm)
A gelatin layer containing yellow colloidal silver and an emulsification dispersion of 2,5-di-t-octyl hydroquinone.

Ninth layer: Low speed blue-sensitive silver halide emulsion layer (BL-1) (2.1 μm)
A monodispersed emulsion (emulsion III) comprising AgBrI containing 4 mol % of AgI and having an average grain size of 0.8 μm . . . 0.9 g/m² in coated silver amount
Sensitizing dye V . . . $1.3\times10^{-4}$ mol per mol of silver
Yellow coupler (Y-1) . . . 0.18 mol per mol of silver
DIR compound (D'-25) . . . 0.003 mol per mol of silver Tenth layer: High speed blue-sensitive silver halide emulsion layer (BH-1) (2.0 μm)
A monodispersed emulsion (emulsion IV) comprising AgBrI containinging 7 mol % of AgI and having an average grain size of 0.8 μm
Emulsion IV . . . 0.5 g/m² in coated silver amount
Sensitizing dye V . . . $1.0\times10^{-4}$ mol per mol of silver
Yellow coupler (Y-1) . . . 0.08 mol per mol of silver Eleventh layer: First protective layer (Pro-1) (1.1 μm)
A gelatin layer containing;
silver iodobromide (AgI: 1 mol %, average grain size: 0.07 μm) . . . 0.5 g/m² in coated silver amount; and ultraviolet absorbents UV-1 and UV-2.

Twelfth layer: Second protective layer (Pro-2) (0.7 μm)
A gelatin layer containing polymethyl methacrylate particles (diameter: 1.5 μm) and formalin scavenger (HS-1).

In the respective layers, gelatin-hardening agents (H-1) and (H-2) and a surface active agent were added in addition to the above composition.

The compounds contained in the respective layers of sample 1 are as follows:

Sensitizing dye I: Anhydro-5,5'-dichloro-9-ethyl-3,3'-di-(3-sulfopropyl)thiacarbocyanine hydroxide
Sensitizing dye II: Anhydro-9-ethyl-3,3'-di-(3-sulfopropyl)-4,5,4',5'-dipenzothiacarbocyanine hydroxide
Sensitizing dye III: Anhydro-5,5'-diphenyl-9-ethyl-3,3'-di-(3-sulfopropyl)oxacarbocyanine hydroxide
Sensitizing dye IV: Anhydro-9-ethyl-3,3'-di-(3-sulfopropyl)-5,6,5',6'-dibenzoxacarbocyanine hydroxide
Sensitizing dye V: Anhydro-3,3'-di-(3-sulfopropyl)-4,5-benzo-5'-methoxythiacyanine hydroxide

C-1

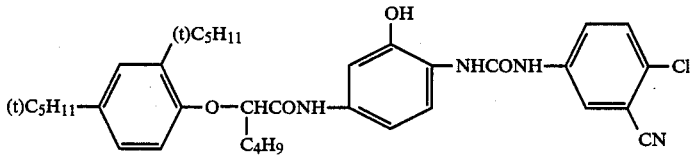

C-2

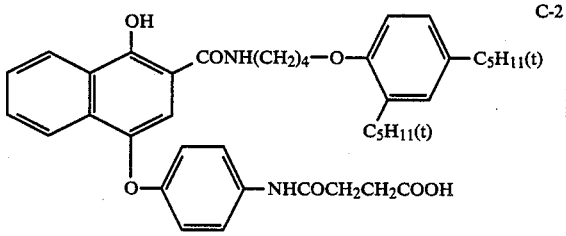

C-3

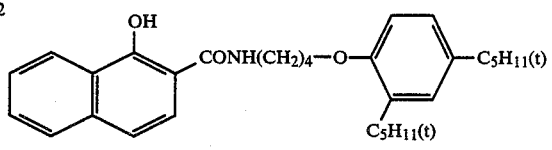

CC-1

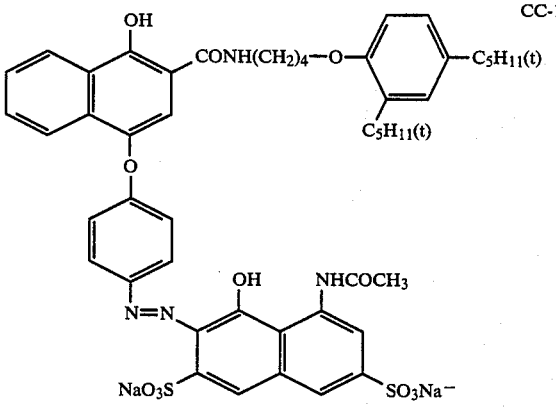

A

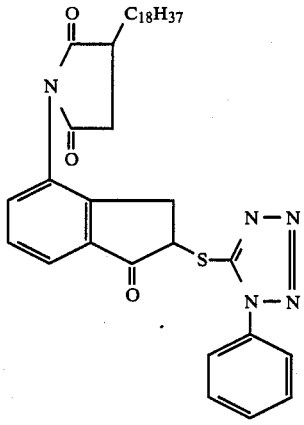

-continued
D'-25
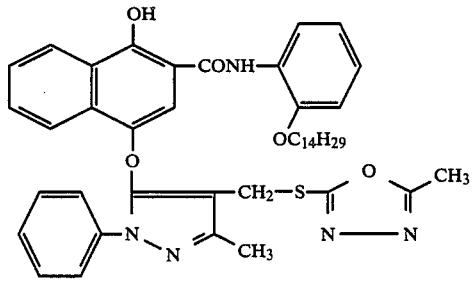
D'-32
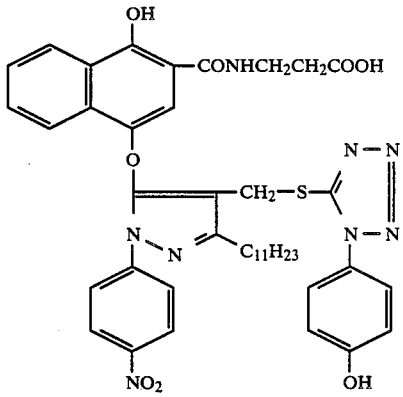
D'-4
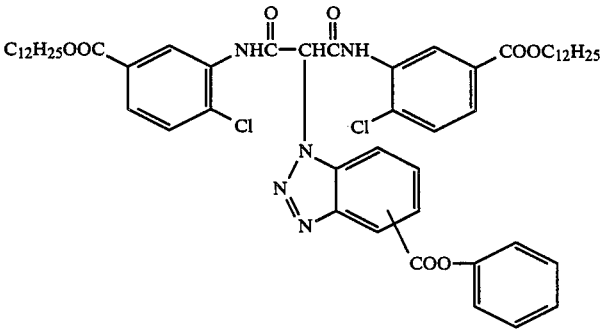
M-1
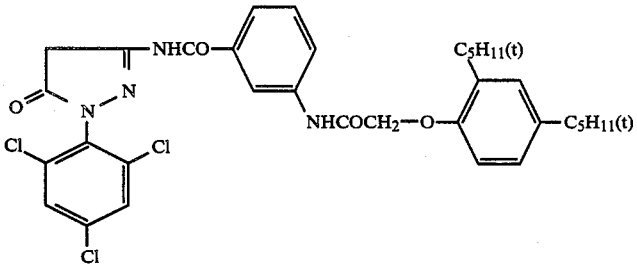
M-2
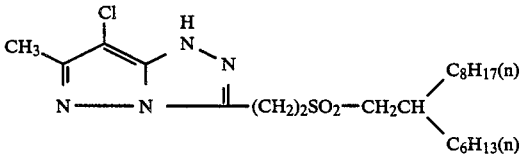
M-3
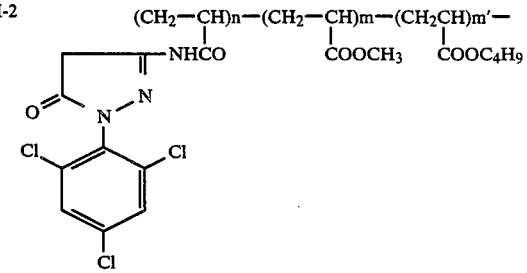
$n/(m + m') = 1$
$m/n' = 1$ (wt. ratio) $\overline{MW} \approx 3000$ -continued

CM-1

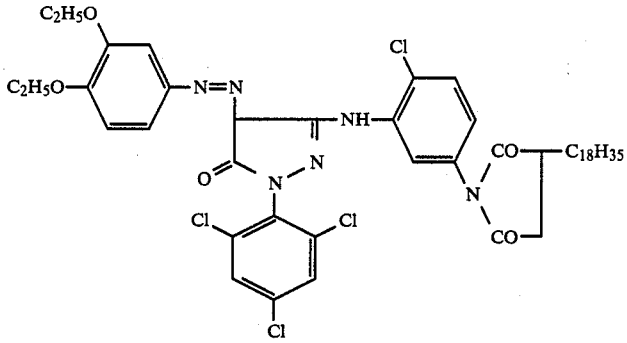

Y-1

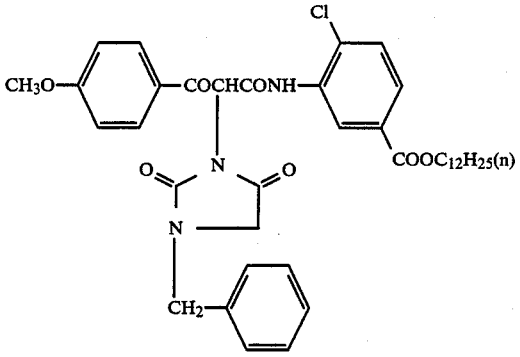

UV-1

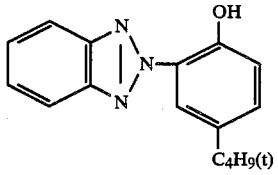

UV-2

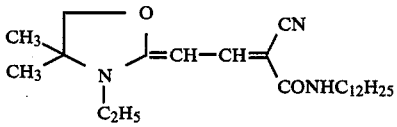

HS-1

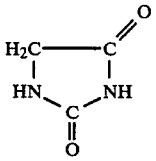

H-1

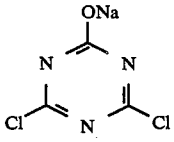

H-2

$[(CH_2{=}CHSO_2CH_2)_3CCH_2SO_2(CH_2)_2]_2N$
$(CH_2)_2SO_3K$

Next, with regard to the above sample No. 1, the type of the coupler, the type and amount of the DIR compound, and the dry layer thickness were varied as shown in Table 1 and others were prepared in the same manner as in sample 1 to produce samples No. 2 to No. 9.

TABLE 1

| | Sample No: | | | | | | | | |
|---|---|---|---|---|---|---|---|---|---|
| | 1 | 2 | 3 | 4 | 5 | 6 | 7 | 8 | 9 |
| Seventh layer | | | | | | | | | |
| Coupler: | M-1 | M-1 | M-1 | M-1 | M-1 | M-1 | M-1 | M-1 | M-1 |
| DIR compound: | — | — | — | D'-32 | D'-32 | D'-32 | D'-32 | D'-4 | D'-32 |
| Amount thereof: | — | — | — | 0.0030 | 0.0030 | 0.0030 | 0.0030 | 0.0030 | 0.0024 |
| Layer thickness: | 2.3 | 2.0 | 1.5 | 2.0 | 1.5 | 1.5 | 1.5 | 1.5 | 1.5 |
| Sixth layer | | | | | | | | | |
| Coupler: | M-1 | M-1 | M-1 | M-1 | M-1 | M-2 | M-3 | M-2 | M-2 |
| DIR compound: | D'-32 | D'-32 | D'-32 | — | — | — | — | — | D'-32 |
| Amount thereof: | 0.0030 | 0.0030 | 0.0030 | — | — | — | — | — | 0.0006 |
| Layer thickness: | 3.2 | 2.6 | 1.8 | 2.6 | 1.8 | 1.8 | 1.8 | 1.8 | 1.8 |
| Total layer thickness of the two layers: | 5.5 | 4.6 | 3.3 | 4.6 | 3.3 | 3.3 | 3.3 | 3.3 | 3.3 |

In the above, amount: mol number per mol of silver; and layer thickness: μm.

The respective samples No. 1 to No. 9 were exposed to light with use of white light, followed by development processing according to the following:

| Processing steps (38° C.): | |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |

-continued

| Processing steps (38° C.): |
|---|
| Drying |

Processing solutions used in the respective processing steps had the formulation as follows.

| | |
|---|---|
| [Color developing solution] | |
| 4-Amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Made up to 1 liter by adding water. | |
| [Bleaching solution] | |
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 g |
| Made up to 1 liter by adding water, and adjusted to pH = 6.0 with use of ammonia water. | |
| [Fixing solution] | |
| Ammonium thiosulfate | 175.0 g |
| Anhydrous sodium sulfite | 8.5 g |
| Sodium metasulfite | 2.3 g |
| Made up to 1 liter by adding water and adjusted to pH = 6.0 with use of acetic acid. | |
| [Stabilizing solution] | |
| Formalin (a 37% aqueous solution) | 1.5 ml |
| Konidax (produced by Konishiroku Photo Industry Co., Ltd.) | 7.5 ml |
| Made up to 1 liter by adding water. | |

After the above processing was carried out, the sharpness and graininess of the images obtained in the above respective samples were measured to obtain the results as shown in Table 2.

For the measurement, exposure was made with use of white light, and the sharpness (MTF) and granularity (RMS) of the above green-sensitive layer was measured with use of green light.

Obtaining MTF (modulation transfer function) of a dye image, the effect of improving the sharpness in contrast to sample No. 1 was indicated in terms of a relative value (assuming as 100 the value for sample No. (1) of the MTF at 10 lines/mm.

The RMS value was indicated in terms of a 1,000 time value of the standard deviation of the variation in density values caused when the density at minimum density +1.0 was scanned with a microdensitometer having an open scanning area of 250 $\mu m^2$.

TABLE 2

| | Sample No.: | | | | | | | | |
|---|---|---|---|---|---|---|---|---|---|
| | 1 | 2 | 3 | 4 | 5 | 6 | 7 | 8 | 9 |
| Sharpness: | 100 | 112 | 118 | 125 | 145 | 148 | 149 | 146 | 140 |
| Graininess: | 28 | 33 | 39 | 26 | 26 | 23 | 24 | 23 | 27 |

In the above respective samples, samples No. 1 to No. 3 are comparative samples, and samples No. 4 to No. 9 are the samples according to the present invention.

From the above results, it is understood that when the DIR compound is added in only the low speed layer (sixth layer) and the layer thickness is reduced to vary from 5.5 to 4.6 or 3.3, the sharpness may certainly increase, but the graininess becomes lower on the contrary.

However, when the DIR compound is added in only the high speed layer (seventh layer) and the layer thickness is reduced to 4.6 μm which is not more than 5 μm as aimed in the present invention, both the sharpness and graininess are seen to have been improved. When the layer thickness is further reduced to 3.3 μm, the sharpness is seen to have been greatly improved, the graininess being substantially constant.

Accordingly, it is clear that both the sharpness and graininess can be improved as described above when the DIR compound is added in the high speed layer and also the total layer thickness of the low speed layer and high speed layer is reduced to 5.0 μm or less.

In the present Examples, the sharpness and graininess were measured for only the green-sensitive layer. However, it has been confirmed that substantially the same results can be obtained also in respect of other red-sensitive layer and blue-sensitive layer, though with some difference in the degree.

Thus, according to the present invention, there can be obtained a high quality image having good sharpness and graininess.

What is claimed is:

1. A silver halide color photographic material comprising a support having thereon photographic component layers comprising at least two silver halide emulsion layers, adjacent to each other, each of said emulsion layers having the same color sensitivity and different speeds, wherein the highest speed layer among said emulsion layers contains a DIR compound capable of releasing either a diffusible development inhibitor having a diffusibility of 0.40 or more, or a diffusible compound having a diffusibility of 0.40 or more and is capable of releasing a development inhibitor.

the total thickness of said silver halide emulsion layer being within the range of from 1.5 μm to 5 μm.

2. The silver halide color photographic material of claim 1, wherein said photographic component layers comprise two silver halide emulsion layers having the same color sensitivity and different speed from each other.

3. The silver halide color photographic light-sensitive material of claim 1, wherein said photographic component layers comprise three silver halide emulsion layers having the same color sensitivity and different speed from each other.

4. The silver halide color photographic material of claim 2, wherein a non-light-sensitive intermediate layer is provided to the interposition of said two silver halide emulsion layers.

5. The silver halide color photographic material of claim 3, wherein at least one non-light-sensitive intermediate layer is provided to the interpositions of said three silver halide emulsion layers.

6. The silver halide color photographic material of claim 1, wherein said silver halide emulsion layers having the same color sensitivity are green-sensitive emulsion layers.

7. The silver halide color photographic material of claim 6, wherein said photographic component layers comprise at least two red-sensitive silver halide emulsion layers in which the highest speed layer among these red-sensitive emulsion layers contains said DIR compound, and the total thickness of said red-sensitive silver halide emulsion layers are within the range of from 1.5 μm to 5 μm.

8. The silver halide color photographic material of claim 1, wherein said DIR compound is contained in said highest speed emulsion layer in proportion of 0.05 mol % or more to silver halide contained in said highest speed emulsion layer.

9. The silver halide color photographic material of claim 8, wherein said proportion of said DIR compound is within the range of from 0.1 to 10 mol%.

10. The silver halide color photographic material of claim 9, wherein said proportion of said DIR compound is within the range of from 0.2 to 5 mol%.

11. The silver halide color photographic material of claim 1, wherein a lower speed layer among these silver halide emulsion layers contains said DIR compound.

12. The silver halide color photographic material of claim 11, wherein the proportion of said DIR compound contained in said lower speed emulsion layer to silver halide contained said lower speed emulsion layer is lower than that of said DIR compound contained in said highest speed emulsion layer.

13. The silver halide color photographic material of claim 12, wherein said proportin of said DIR compound contained in said lower speed emulsion layer is lower than ½ of the proportion of said DIR compound cointained in said highest speed emulsion layer.

14. The silver halide color photographic material of claim 1 wherein said emulsion layers have a non-light-sensitive intermediate layer interposed therebetween.

15. The silver halide color photographic material of claim 1, wherein said DIR compound is selected from the compounds represented by the formula (D-1):

Formula (D-1)

A—(Y)m wherein A is a coupler residue; m is an integer of 1 or 2; and Y is a group represented by the following formula (D-2) or (D-3) which is bonded to the coupling position of A and is capable of releasing upon reaction with the oxidized product of a color developing agent:

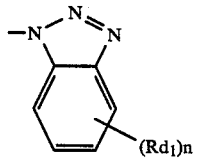

Formula (D-2)

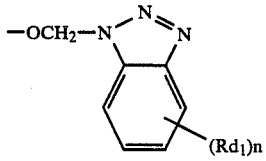

Formula (D-3)

wherein $Rd_1$ is a hydrogen atom, a halogen atom, an alkyl group, an alkoxy group, an acylamino group, an alkoxycarbonyl group, a thiazolylideneamino group, an aryloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkyl-carbamoyloxy group, a hydroxy group, an alkoxycarbonylamino group, an alkylthio group, an arylthio group, an aryl group, a heterocyclic ring, a cyano group, an alkylsulfonyl group or aryloxycarbonylamino group; n is an integer of 0, 1 or 2, $Rd_1$s may be the same or different each other when n is 2; and the number of carbon atoms contained in n of $Rd_1$ is 0 to 10 in total.

16. The silver halide color photographic material of claim 1, wherein said DIR compound is selected from the compounds represented by the formula (D-10):

Formula (D-10)

A—TIME—INHIBIT wherein A is the same as in the formula (D-1); —TIME— is a group capable of bonding to the coupling position of A and undergoing cleavage upon the reaction with the oxidized product of a color developing agent, and is capable of releasing an —INHIBIT group with appropriate control after cleavage from A; —INHIBIT is a group represented by the formula (D-2), (D-6) or (D-8), in which the formula (D-2) is the same as that in the formula (D-1):

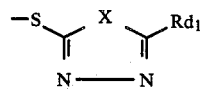

Formula (D-6)

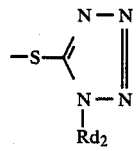

Formula (D-8)

wherein $Rd_1$ is the same as in the formula (D-2) and $Rd_2$ is an alkyl group, an aryl group or a heterocyclic group.

17. The silver halide color photographic material of claim 1, wherein the total thickness of said silver halide emulsion layers having the same color sensitivity is within the range of from 1.5 μm to 4 μm.

18. The silver halide color photographic material of claim 17, wherein the total thickness of said silver halide emulsion layers having the same color sensitivity are within the range of from 1.5 μm to 3 μm.

19. The silver halide color photographic material of claim 1, wherein a thickness of a whole of the all photographic compoment layers including said silver halide emulsion layers is 18 μm or less.

20. The silver halide color photographic material of claim 19, wherein a thickness of a whole of the all photographic component layers including said silver halide emulsion layers is within the range of from 10 μm to 16 μm.

21. A silver halide color photographic material of claim 2, wherein said two silver halide emulsion layers are green-sensitive emulsion layers and a diffisibility of a development inhibitor or a compound capable of releasing a development inhibitor released from said DIR compound contained in said highest speed emulsion layer is 0.40 and the total thickness of said two emulsion layers is within the range of from 1.5 μm to 4 μm.

22. The silver halide color photographic material of claim 21, wherein the total thickness of said two silver halide emulsion layers is within the range of from 1.5 μm to 3 μm.

23. The silver halide color photographic material of claim 7 wherein said red-sensitive emulsion layers have a non-light-sensitive intermediate layer positioned therebetween.

* * * * *

UNITED STATES PATENT AND TRADEMARK OFFICE

CERTIFICATE OF CORRECTION

PATENT NO. : 4,804,619

DATED : February 14, 1989

INVENTOR(S) : Yamada et al

It is certified that error appears in the above-identified patent and that said Letters Patent is hereby corrected as shown below:

Column 28 line 37 change "layer" to --layers--.

Signed and Sealed this

Twenty-fifth Day of October, 1994

*Attest:*

*Attesting Officer*

BRUCE LEHMAN

*Commissioner of Patents and Trademarks*